US011493291B2

(12) United States Patent
Koehler et al.

(10) Patent No.: US 11,493,291 B2
(45) Date of Patent: Nov. 8, 2022

(54) STRAIGHT PULL FASTENER FOR BOLT ACTION RIFLES AND REPEATING WEAPON WITH THIS ONE

(71) Applicant: Merkel Jagd—und Sportwaffen GmbH, Suhl (DE)

(72) Inventors: Rainer Koehler, Foeritztal (DE); Lutz Morgenroth, Merbelsrod (DE)

(73) Assignee: MERKEL JAGD—UND SPORTWAFFEN GMBH, Suhl (DE)

( * ) Notice: Subject to any disclaimer, the term of this patent is extended or adjusted under 35 U.S.C. 154(b) by 0 days.

(21) Appl. No.: 17/489,875

(22) Filed: Sep. 30, 2021

(65) Prior Publication Data

US 2022/0099391 A1 Mar. 31, 2022

(30) Foreign Application Priority Data

Sep. 30, 2020 (DE) ..... 10 2020 125 592.6

(51) Int. Cl.
*F41A 3/20* (2006.01)
*F41A 3/72* (2006.01)

(52) U.S. Cl.
CPC . *F41A 3/20* (2013.01); *F41A 3/72* (2013.01)

(58) Field of Classification Search
CPC ..... F41A 3/20; F41A 3/22
See application file for complete search history.

(56) References Cited

U.S. PATENT DOCUMENTS

| | | | |
|---|---|---|---|
| 9,658,007 | B2 | 5/2017 | Withey |
| 10,746,485 | B2 * | 8/2020 | Braceras Devecchi ... F41A 3/30 |
| 2015/0020423 | A1 | 1/2015 | Withey |

FOREIGN PATENT DOCUMENTS

| | | | |
|---|---|---|---|
| DE | 10009616 | C2 | 9/2002 |
| DE | 102018122573 | B3 | 12/2019 |

* cited by examiner

*Primary Examiner* — Reginald S Tillman, Jr.
(74) *Attorney, Agent, or Firm* — Stuart H. Mayer; Mayer & Williams PC

(57) ABSTRACT

A bolt-action weapon includes a receiver rotatable about a longitudinal axis, a first gear component, a second gear component and a bolt-action lever. At its front end, the receiver has a non-rotating bolt head. The first gear component is attached to the rear end of the receiver in a rotationally fixed manner, wherein the receiver rotates with the first gear component when the latter rotates. The second gear component lies at an angle to the first gear component and is in engagement with the latter for mechanical transmission of a rotational movement. The bolt-action lever is connected to the second gear component such that the bolt-action lever can rotate with it, whereby the bolt-action lever can be engaged in at least two functional positions. The bolt-action lever is movable back and forth in axial direction together with the two gear components and the receiver.

11 Claims, 9 Drawing Sheets

30
09
09
09
30
47
51
51
48
52
53
53
48
52
49
47
49
49

STRAIGHT PULL FASTENER FOR BOLT ACTION RIFLES AND REPEATING WEAPON WITH THIS ONE

BACKGROUND OF THE INVENTION

This invention relates to a straight pull action for bolt-action weapons. Furthermore, the invention relates to a bolt-action weapon with a straight pull action.

A straight pull action is a bolt-action weapon. According to the German Weapons Act, Annex 1, No. 2.3, bolt-action weapons are "firearms in which, after firing, ammunition is reloaded from a magazine into the chamber by means of a manually operated mechanism." Bolt-action weapons also include bolt-action firearms or bolt-action rifles.

Bolt-action weapons usually have a cylinder action as a bolt-action bolt. In an open position of the bolt, a cartridge is fed into the chamber. If the bolt is then moved to a closed position, the weapon is loaded. After firing and/or changing from the closed to the open bolt position, the cartridge sleeve is ejected and a new cartridge is fed into the chamber. At the same time, when changing from the open bolt position to the closed bolt position, a firing pin spring that is coaxial with a firing pin is tensioned so that a new firing of a shot is possible.

Bolt-action bolts regularly comprise a bolt handle or bolt-action lever and a safety. The safety serves to prevent an unwanted firing of a shot. Cylinder actions also comprise at least one locking lug, a cartridge extractor, a sleeve, and a firing pin with firing pin spring.

DE 100 09 616 C2 describes a straight pull action with a rotating lug lock for bolt-action rifles. The straight pull action comprises a receiver which is arranged in a bolt sleeve, the receiver being movable back and forth by means of a bolt handle. A bolt head with locking lugs is rotatably mounted in the receiver by means of a shaft. The receiver comprises a firing pin which is impinged upon by a firing pin spring. The receiver is used to generate rotational momentum in order to rotate the bolt head that is in the locking position into the locking chamber corresponding to the locking lugs. Furthermore, the straight pull action has a locking lever as a locking means, which locking lever is pivotably mounted on the receiver. The locking lever prevents relative movement between the receiver and bolt head. A spring impinges on the locking lever in the locking direction.

DE 196 08 872 C1 describes a bolt device for bolt-action rifles. The bolt device has a chamber lever that can be locked in the forward position and cooperates with a locking device. Furthermore, the bolt device comprises a firing pin which can be latched in a first rear position by means of a latching device. The chamber lever can be set in various positions in a straight-line movement.

DE 10 2016 120 891 A1 describes a bolt device for firearms. The bolt device comprises an externally located sleeve in which a chamber is arranged. The chamber has a bolt head. A control piece is slidably mounted inside the chamber. A chamber lever is connected to the control piece so that the bolt head is unlocked when the chamber lever moves backward and locked when it moves forward. The bolt head is rotated by axial displacement of the control piece.

A straight pull action for a bolt-action rifle is known from DE 10 2018 122 573 B3. The straight pull action comprises a receiver mounted rotationally about a longitudinal axis. A control cam extending obliquely to the longitudinal axis is incorporated in the rear region of the inner jacket of the receiver. Furthermore, the straight pull action comprises a connecting element with a pin attached to the front end, which engages with the control cam.

SUMMARY OF THE INVENTION

Based on this prior art, one object of this invention is to improve a straight pull action so that it can be used more easily and safely in a bolt-action weapon by a user. It is a further object to provide a simple, inexpensive design for a straight pull action. It is also an object of the invention to provide a bolt-action weapon with a straight pull action with integrated manual cocking system, in which the cocking of the firing pin spring is carried out manually before firing and simultaneously with the cartridge change.

The aforementioned task is solved by a straight pull action for bolt-action weapons according to the appended claim 1 as well as by a bolt-action weapon according to the adjoining claim 10.

The straight pull action for bolt-action weapons according to the invention, in particular for bolt-action rifles, comprises a receiver, a first gear component, a second gear component and a bolt-action lever. The receiver is a cylindrical hollow body that can be rotated about a longitudinal axis. The longitudinal axis is parallel, preferably coaxial, to the barrel axis of the weapon, wherein for the following considerations the muzzle of the barrel is to be regarded as lying in front. A bolt head is arranged at the front end of the receiver. At the rear end, which is located on the side opposite to the front end, the first gear component is arranged in a rotationally fixed manner on the receiver. When the first gear component rotates, the rotation is transmitted to the receiver so that it rotates. When the receiver rotates, the bolt head rotates with it. The second gear component lies at an angle, preferably at a right angle, to the first gear component. The two gear components are in engagement with each other so that a rotational movement about a first axis transverse to the barrel axis can be transferred to a rotary movement about a second axis parallel to the barrel axis. The bolt-action lever, which can also be referred to as a bolt handle, is connected to the second gear component. The bolt-action lever is a lever arranged in the area of an axis of rotation of the second gear component. The bolt-action lever is, at least in sections, rotatable about the common axis of rotation with the second gear component. When the bolt-action lever rotates, it can be locked in at least two functional positions. A first functional position is the locking position, in which the bolt head is locked or alternatively brought into a locked position by moving or alternatively rotating the bolt-action lever into the locking position, usually initiated by a user/operator of the weapon. In this manner, the rotational movement about the first axis transverse to the barrel axis is transferred by the movement of the bolt-action lever by means of the two gear components into the rotational movement about the second axis parallel to the barrel axis, and the receiver is rotated with the bolt head about the longitudinal axis by means of the first gear component such that the bolt head is rotated into the locked position. The locking of the bolt head is necessary so that the pressure generated during firing does not cause the receiver, with the components attached to it, to move in the axial direction.

The second functional position is the unlocking position, wherein the bolt head is unlocked or alternatively brought into an unlocked position, preferably by the user, by moving or alternatively rotating the bolt-action lever into the unlocking position. In this manner, the rotational movement about the first axis transverse to the barrel axis is transferred by the movement of the bolt-action lever by means of the two gear components into the rotational movement about the second axis parallel to the barrel axis, and the receiver is rotated with the bolt head about the longitudinal axis of the receiver by means of the first gear component such that the bolt head is rotated into the unlocked position. The rotation to the unlocked position and the rotation to the locked position are opposite movements, such that one rotation is in the positive direction of rotation and the other rotation is in the negative direction of rotation. The twisting or rotation of the bolt-action lever about the axis of rotation occurs in a vertical plane when the weapon is in the usual direction of firing, i.e., with the barrel axis lying substantially in a horizontal direction. Furthermore, the bolt-action lever and together with it, the gear components, the receiver and the bolt head, can be moved forward and backward in the axial direction or back and forth so that, if necessary, a cartridge sleeve can be ejected, and a cartridge inserted into a chamber.

A significant advantage of this design of the straight pull action is that the operator can move the bolt-action lever back and forth along a continuous path of movement during bolt-action. Instead, in previously known bolt-action weapons, at least two discontinuous combined movement sections are traditionally required.

In a preferred embodiment, the first gear component is a first bevel gear which preferably has a cylindrical extension at its first end abutting the receiver. At its second end, which is opposite the first end, the first bevel gear preferably has circumferential teeth. Particularly preferably, the first bevel gear has teeth in one section. The teeth together form a gear rim or a gear rim section.

Alternatively, the first gear component is, for example, a control cam having a recess in which the second gear component engages. In modified embodiments, the gear components may be replaced by other per se known components, which enable the aforementioned deflection of the movements/rotations.

Along the longitudinal axis of the first gear component, the first gear component preferably has a through hole. Preferably, the first gear component is coaxially surrounded by the receiver in sections.

In a preferred embodiment, the second gear component is a second bevel gear which preferably has circumferential teeth which mesh with the teeth of the first bevel gear. Particularly preferably, the teeth of the second bevel gear are formed on a section. The teeth of the second bevel gear form a gear rim and preferably lie predominantly on a side surface of the bevel gear. The second bevel gear may also be referred to as the input bevel gear, whereas the first bevel gear forms the output bevel gear. In this case, the bolt-action lever is preferably arranged on the side surface of the second bevel gear, opposite the teeth.

Alternatively, the second gear component has a shape which can be rotated with the bolt-action lever about the axis of rotation, wherein on a side facing away from the bolt-action lever there is an elevation which engages in the complementary recess of the first gear component. The elevation can, for example, be a pin.

The advantage of this straight pull action is a simple conversion of a movement in a first plane into a movement in a second plane, so that a longitudinal displacement of the bolt-action lever parallel to the rifle barrel or alternatively to the sleeve of the rifle is converted into a rotational movement of the receiver with the bolt head within the sleeve. Converting the motion by means of the bevel gears or alternatively gear components acting with a similar effect provides an improved straight pull action that is easy to assemble and simple as well as safe to use.

Preferably, the straight pull action further comprises a firing pin and a firing pin spring. The firing pin is arranged coaxially with the receiver and has a firing pin collar in its front region. The firing pin spring is arranged coaxially on the firing pin and preferably lies with one end abutting directly against the firing pin collar and with the other end preferably abutting against a lock sleeve. The firing pin is movable along the longitudinal axis of the receiver.

The straight pull action further preferably comprises the lock sleeve disposed on the first gear component and a connecting element. The lock sleeve and the connecting element are positioned in an axially rearward region of the firing pin, wherein both the lock sleeve and the connecting element preferably have a through hole through which the firing pin is guided and thus the lock sleeve and the connecting element are arranged one behind the other. The connecting element, which can also be referred to as a latching tab, is arranged non-rotatably on the firing pin.

In one embodiment, the second gear component has, on its surface opposite the bolt-action lever, two spaced-apart pegs extending along the axis of rotation. The pegs extend parallel to the axis of rotation of the second gear component, preferably at 90 degrees to the second gear component. The pegs may be cylindrical elevations, alternatively the pegs may be an elevation of any shape.

The first peg preferably abuts the lock sleeve as well as the connecting element. Upon rotation of the bolt-action lever to the locking position, as previously described, a transmission of movement to the second gear component with the pegs disposed thereon occurs. Movement of the first pin causes simultaneous longitudinal movement of the firing pin, of the connecting element and of the lock sleeve along the longitudinal axis.

Furthermore, the straight pull action preferably comprises a trigger sear, against which the connecting element abuts as soon as the bolt-action lever is rotated into the locking position. The engagement of the fastener with the trigger sear prevents the fastener from moving further along the longitudinal axis, thus reducing the distance between the firing pin collar and the lock sleeve, which tensions the firing pin spring. Tensioning of the firing pin spring is required to initiate firing.

In one embodiment, the straight pull action further comprises an extractor element, which is guided into a receiver notch by means of the second pin of the second gear component when the bolt-action lever is rotated to the unlocking position, such that rotational movement of the receiver and thus of the two gear components is prevented. The extractor element preferably comprises an extractor pin and forcedly-controlled extraction. A spring is preferably arranged between the extractor pin and the forcedly-controlled extraction, such that the forcedly-controlled extraction is spring-mounted on the extractor pin. If the bolt-action lever moves from the unlocked position together with the gear components, the receiver and the bolt head in a substantially axial direction, initially backwards and subsequently forwards, the extractor element comes into contact with a component and is thereby pressed out of the receiver notch. As a result, the gear components can again be rotated with the receiver. The component against which the extractor element abuts can be, for example, a sleeve or a rear end of a gun barrel. Particularly preferably, the extractor pin comes to abut against the component in a backward movement of the bolt-action lever in the unlocking position.

In a further embodiment, the straight pull action further comprises a safety element for blocking or releasing a rotational movement of the bolt-action lever. The safety element is lockable in various positions. In a deactivation position, the safety element engages a groove of the second gear component so that a rotational movement of the second gear component and thus a movement of the elements connected to the second gear component are blocked. The deactivation position prevents unintended firing or unintended cocking of the firing pin spring. In the deactivation position of the safety element, the bolt-action lever is safely in a functional position between the unlocking position and the locking position. In this third position, the bolt-action lever cannot be moved to either of the other two positions. In an activation position of the safety element, the safety element does not act on the second gear component, such that the second gear component is rotatable and is not locked. Other positions in which the safety element can be fixed are conceivable.

Preferably, the safety element consists of a safety slider and a latching element, which act together and between which a spring is tensioned. The latching element can also be referred to as a chamber lock.

In one embodiment, an elevation in the form of a lug is formed on the bolt head. Particularly preferably, three lugs are formed on the bolt head. A rotational lug lock can be implemented by means of the elevation on the bolt head which enables the bolt head to be locked in the locking position, whereby the elevation engages. Furthermore, a rotational lug lock allows the bolt head to be unlocked by unscrewing when the bolt-action lever is guided to the unlock position.

The bolt-action weapon according to the invention comprises a straight pull action, which corresponds to the previously described straight pull action, as well as embodiments thereof. In a known manner, the bolt-action weapon comprises a rifle barrel, a fore-end and a buttstock. The rifle barrel is a sleeve arranged on the fore-end. The straight pull action is furthermore at least partially disposed on the fore-end. The straight pull action and the rifle barrel are arranged along a common longitudinal axis. The receiver is surrounded by the rifle barrel.

Furthermore, the bolt-action weapon preferably comprises a chamber, a magazine slot adjacent the chamber in the form of a recess in the fore-end, and a magazine safety element. A magazine filled with cartridges can be inserted into the magazine slot. Making use of the previously described bolt-action process, in which the bolt-action lever together with the receiver and other components is moved axially forwards and backwards by a user, a cartridge is inserted from the magazine or manually into the cartridge chamber.

Preferably, the magazine safety element for the bolt-action is configured to securely hold a magazine that is inserted into the magazine slot in position. The magazine safety element is located at a lower end of the magazine slot. The magazine safety element can be locked in a groove of the magazine slot by moving the magazine safety element transversely to the longitudinal axis, from an initial position to a locking position. The magazine safety element is easily releasable, using one single hand, by displacement from the locking position, i.e. from the groove, to the initial position and subsequent displacement along the longitudinal axis away from the muzzle of the barrel, whereby the magazine is removable.

In one embodiment, the bolt-action weapon further comprises a retaining element, which may also be referred to as a bolt holder. The retaining element is arranged in a rear region of the sleeve and comes to rest in a notch of the sleeve or of a rifle barrel, which is aligned at an angle to the longitudinal axis. The retaining element and the notch are designed in such a way that they can engage with each other. The retaining element serves to hold the receiver so that it is not twisted during a movement along the longitudinal axis.

During the movement of the bolt-action lever together with the receiver and further components along the longitudinal axis, the bolt head preferably comes to rest on a plate, or alternatively preferably in a notch with its lug, such that the maximum opening of the receiver is limited.

BRIEF DESCRIPTION OF THE DRAWINGS

Further advantages, details and further embodiments of the invention will result from the following description of a preferred embodiment, with reference to the drawing. Wherein.

DETAILED DESCRIPTION OF THE INVENTION

Figure 1:
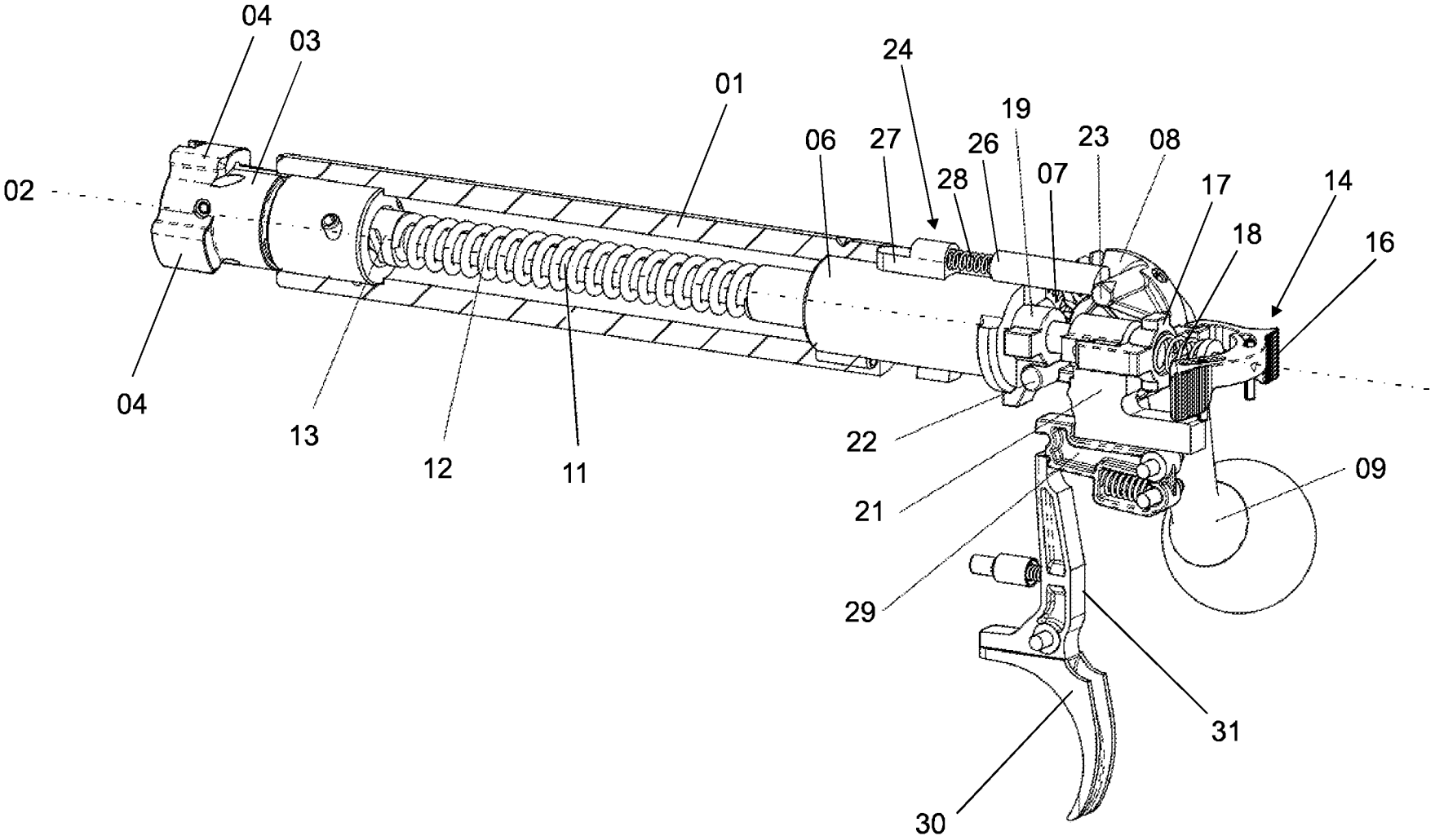
FIG. 1 shows a perspective view of a straight pull action according to the invention.

FIG. 1 shows a perspective side view of a straight pull action for bolt-action weapons according to the invention. The straight pull action comprises a receiver 01, which can be rotated about a longitudinal axis 02. When inserted in a weapon, the longitudinal axis 02 is coaxial with the barrel axis of the weapon. A bolt head 03 is arranged non-rotatably at the front end of the receiver 01. The bolt head 03 has three lug extensions 04 around its circumference. A first gear component in the form of a first bevel gear 06 is non-rotatably arranged at the rear end of the receiver 01. The first bevel gear 06 has a cylindrical base body, at the rear end of which a plurality of teeth 07 are formed, at least in one section. A through hole (not shown) extends through the cylindrical base body of the first bevel gear 06, which through hole extends along the longitudinal axis 02. The straight pull action furthermore comprises a second gear component in the form of a second bevel gear 08 positioned at a 90° angle to the first bevel gear 06 and engaging with said first bevel gear. The second bevel gear 08 also comprises, at least in sections, a plurality of teeth that engage the teeth 07 of the first bevel gear 06. A rotational movement can be mechanically transmitted between the first bevel gear 06 and the second bevel gear 08, wherein the respective axes of rotation are preferably perpendicular to each other. The straight pull action furthermore comprises a bolt-action lever 09 which is connected to the second bevel gear 08, preferably aligned with an axis of rotation 10 (FIG. 2) of the second bevel gear 08. Bolt-action lever 09 and second bevel gear 08 are jointly rotatable, at least in sections, about the common axis of rotation 10. If the bolt-action lever 09 is moved by a user about the axis of rotation 10, the second bevel gear 08 also rotates, as does the first bevel gear 06, which is in engagement with the second bevel gear 08, and with it the receiver 01 attached thereto. The bolt head 03 rotates with the receiver 01. The various functional positions of the bolt-action lever are described below with reference to FIG. 2.

FIG. 1 furthermore shows that the straight pull fastener comprises a firing pin 11 arranged in the receiver 01 and impinged upon by a firing pin spring 12. The firing pin 11 is arranged coaxially to the receiver 01 and has a firing pin collar 13 in its front region. The firing pin spring 12 is arranged coaxially on the firing pin 11 and abuts with one end against the firing pin collar 13 and with the other end against a lock sleeve 19. The firing pin 11 is axially movable along the longitudinal axis 02 of the receiver 01. In its rear portion, the firing pin 11 extends through a through hole of the lock sleeve 19, the lock sleeve 19 being arranged in a through hole of the first bevel gear 06. The through holes extend along the longitudinal axis 02.

FIG. 1 furthermore shows that the straight pull action comprises a safety element 14 for locking or unlocking a rotational movement of the bolt-action lever 09. The safety element 14 comprises a safety slider 16 and a latching element 17 between which a spring 18 is tensioned. The safety slider 16 is movably mounted. The latching element 17 is arranged on top of the firing pin 11 and the spring 18 on the firing pin 11. The spring-mounted safety element 14 can be locked in various positions. The operation of the safety element 14 is explained in more detail with reference to FIG. 6. The lock sleeve 19, which bears against the first bevel gear 06, and a latching tab 21 are axially arranged on the firing pin 11, between the latching element 17 and the first bevel gear 06. The second bevel gear 08 has two pins 22, 23 which are spaced apart from one another and extend parallel to the axis of rotation 10, in the region outside the axis of rotation 10, on its surface facing away from the bolt-action lever 09. The first pin 22 comes to abut against the lock sleeve. The second pin 23 of the second bevel gear 08 cooperates with an extractor element 26 arranged on the first bevel gear 06. The extractor element 24 comprises an extractor pin 26 and a forcedly-controlled extraction 27, as well as an extractor spring 28 arranged there between. The operation of the extractor element 24 is described in more detail in the following illustrations.

FIG. 1 likewise shows a trigger sear 29 arranged on the straight pull action with trigger 30 and trigger rod 31 arranged in between.

Figure 2:
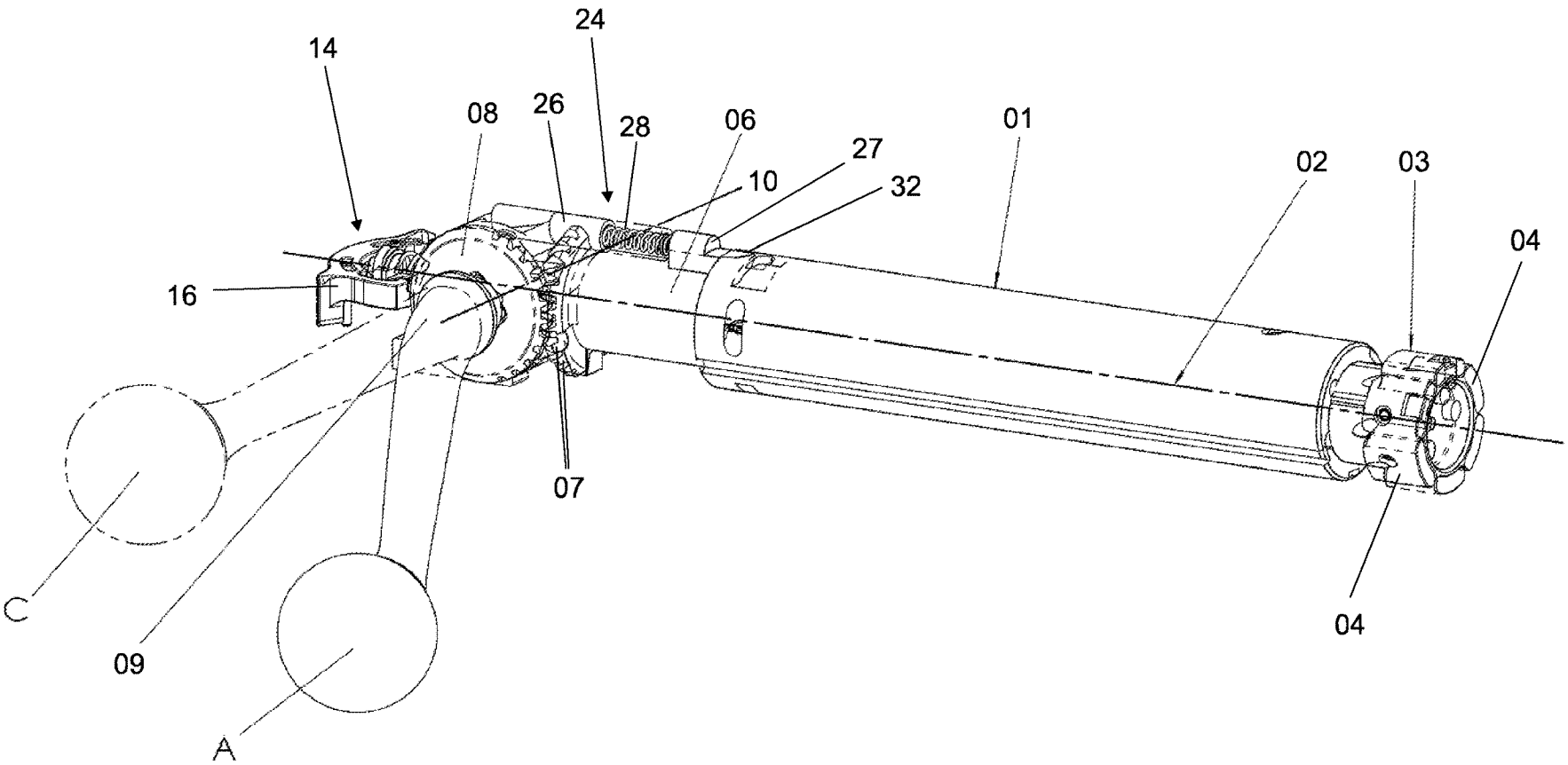
FIG. 2 shows a second perspective view of the straight pull action shown in FIG. 1 with different functional positions.

FIG. 2 shows a second side view of the straight pull fastener shown in FIG. 1, with the various functional positions of the bolt-action lever 09. The bolt-action lever 09 can assume three functional positions. Functional position A is a locking position, functional position B (FIG. 4) is an intermediate position, and functional position C is an unlocking position. The intermediate position B is between the locking position A and the unlocking position C. When the bolt-action lever 09 is moved to the locking position A, the two bevel gears 06, 08 rotate the receiver 01 about its longitudinal axis 02. The receiver 01 rotates the bolt head 03, whose lug extensions 04 lock the bolt head 03 to the cartridge chamber (not shown) when the straight pull action is inserted in an associated weapon. The locking of the bolt head 03 has the effect that pressure generated during a firing operation does not cause movement, in the axial direction, of the receiver 01 together with the firing pin and the components arranged thereupon. Optionally, a transmission ratio not equal to one can be selected in the gear formed by the two bevel gears, so that, for example, a 45° rotation of the bolt-action lever 09 brings about a 90° rotation of the receiver.

If the bolt-action lever 09 is brought into the unlocking position C by a user rotating the bolt-action levers 09, the bolt head 03 arranged on the receiver 01 is unlocked by a rotation which is transmitted by means of the two bevel gears 06, 08. The second pin 23, which is arranged on the second bevel gear 08, displaces the extractor pin 26 in the axial direction when the bolt-action levers 09 are rotated to the unlocking position C, such that the extractor spring is compressed/shortened. The forcedly-controlled extraction 27 is guided into a notch 32 of the receiver 01, such that a movement of the receiver 01, of the first bevel gear 06 and thus also the second bevel gear 09 is blocked.

Figure 3:
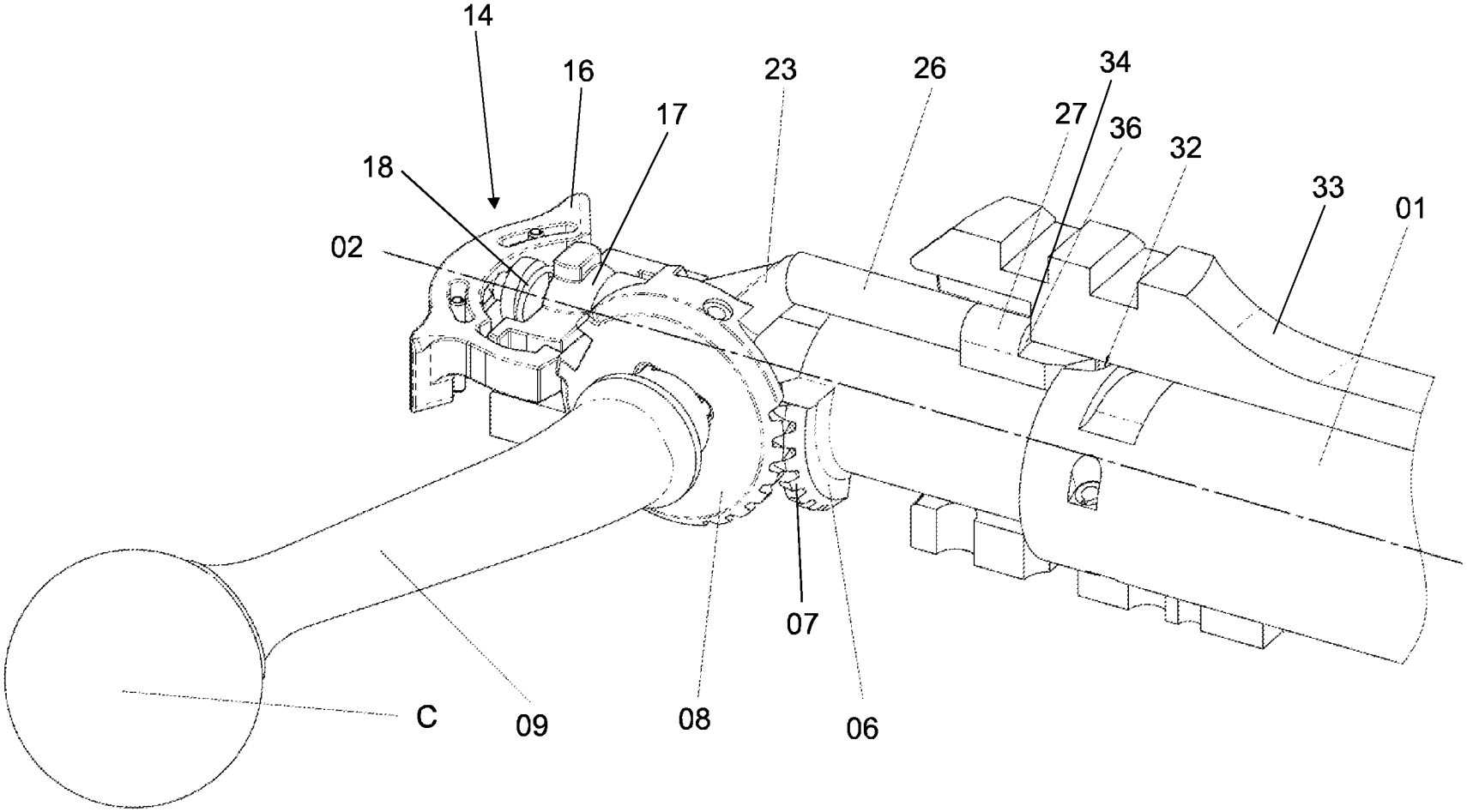
FIG. 3 shows a detail view of the straight pull fastener according to FIG. 1 in a functional position, in particular an unlocking position.

FIG. 3 shows a detail view of the straight pull action according to FIG. 1 in a functional position, namely an unlocking position C, which is also shown in FIG. 2 and was described previously. Deviating from FIG. 2, FIG. 3 shows a sleeve 33 which is to be assigned to the sleeve of the weapon and coaxially surrounds the receiver 01 in installed state. The receiver 01 is movable in the sleeve 33. A contact surface 34 is formed at the rear end of the sleeve 33, which extends radially. In the unlocking position C, the user can move the bolt-action lever 09 in the axial direction to the rear, i.e. against the direction of firing. In so doing, it is not necessary to grip around the bolt-action lever; rather, the movement sequence initiated by the rotation of the bolt-action levers 09 is converted into a linear movement without interruption. If the bolt-action lever 09 is moved axially backwards along the longitudinal axis 02, the forcedly-controlled extraction 27, with a radially formed run-up surface 36 approaches the contact surface 34 of the sleeve 33 shortly before the end position of the bolt-action lever 09 is reached, such that an axial displacement of the receiver 01 together with the bolt head 03 attached to it and other components arranged on it takes place in a direction opposite that of the direction of firing. The axial movement allows a cartridge sleeve to be pulled out of the cartridge chamber and ammunition to be reloaded. A stuck cartridge sleeve is pulled out of the chamber under "force." When the bolt-action lever 09 is moved axially, the forcedly-controlled extraction 27 is pushed out of the notch 32 of the receiver 01, thus allowing the two bevel gears 06, 08 to once again move.

Figure 4:
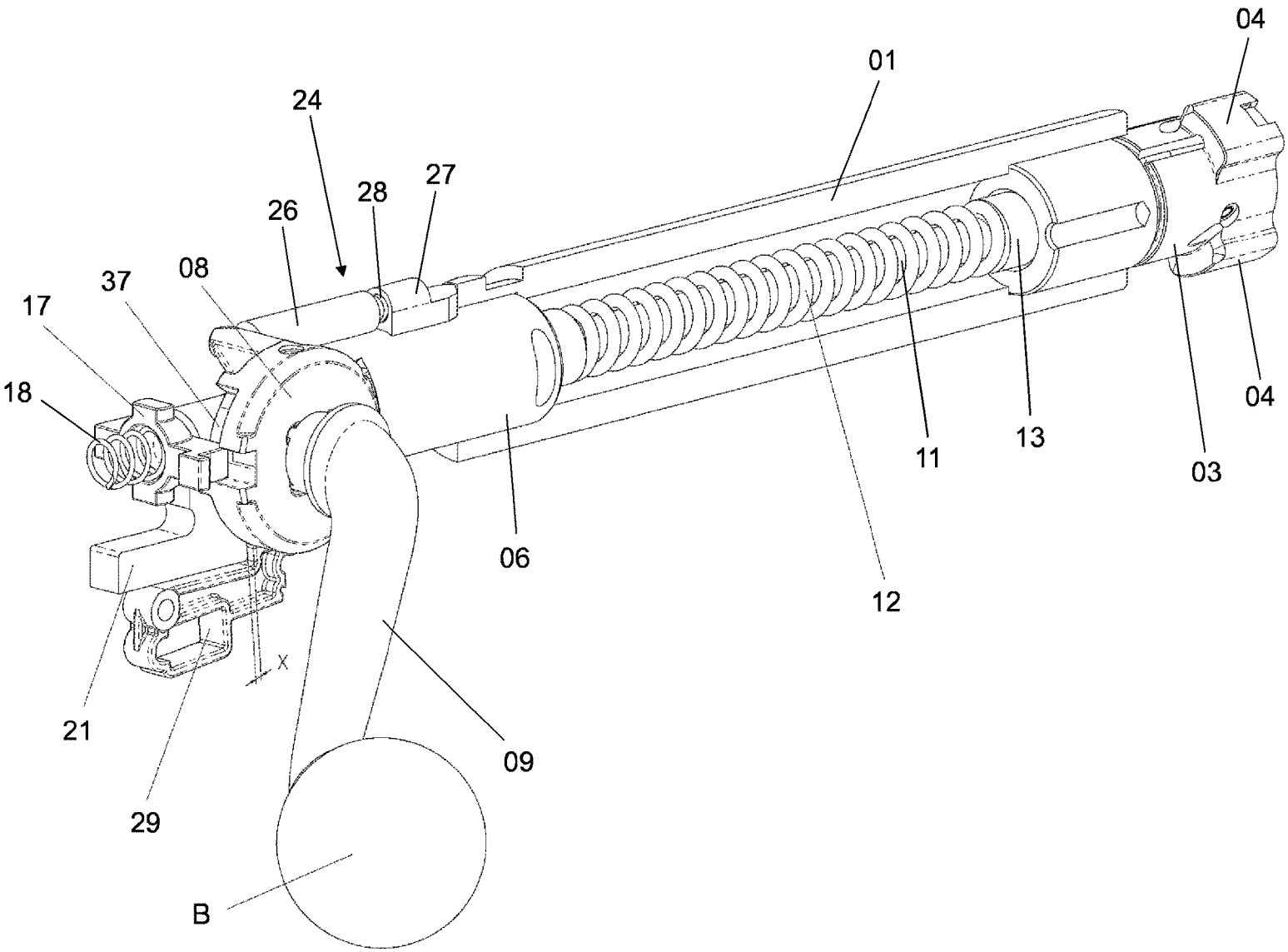
FIG. 4 shows a detail view of the straight pull action according to FIG. 1 in a second functional position.

FIG. 4 shows a detail view of the straight pull action according to FIG. 1 in a functional position, namely an intermediate position B. When the bolt-action lever 09 is pivoted back from the unlocking position C towards the locking position A, it can assume the intermediate position B, with the spring-loaded latching element 17 engaging in a lateral notch 37 of the second bevel gear 08. The lateral notch 37 of the second bevel gear 08 is located in a limited portion of the bevel gear 08. By engaging the latching element 17 in the notch 37 of the second bevel gear 08, a movement of the bolt-action lever 09 back to the unlocking position C is advantageously prevented. In this condition, the latch is approximately 40% locked, the firing pin spring 12 is released, and the latching tab 21 has a distance X from the trigger sear 29. The limited lateral notch 37 of the second bevel gear 08 allows continued movement of the bolt-action lever to the locking position A, but does not allow inadvertent return to the unlocking position C. It can furthermore be seen in FIG. 4 that with continued movement of the bolt-action lever 09 to the locking position A (in relation to the position shown in FIG. 3), the distance between extractor pin 26 and forcedly-controlled extraction 27 has increased, with the extractor spring 28 being relaxed.

Figure 5:
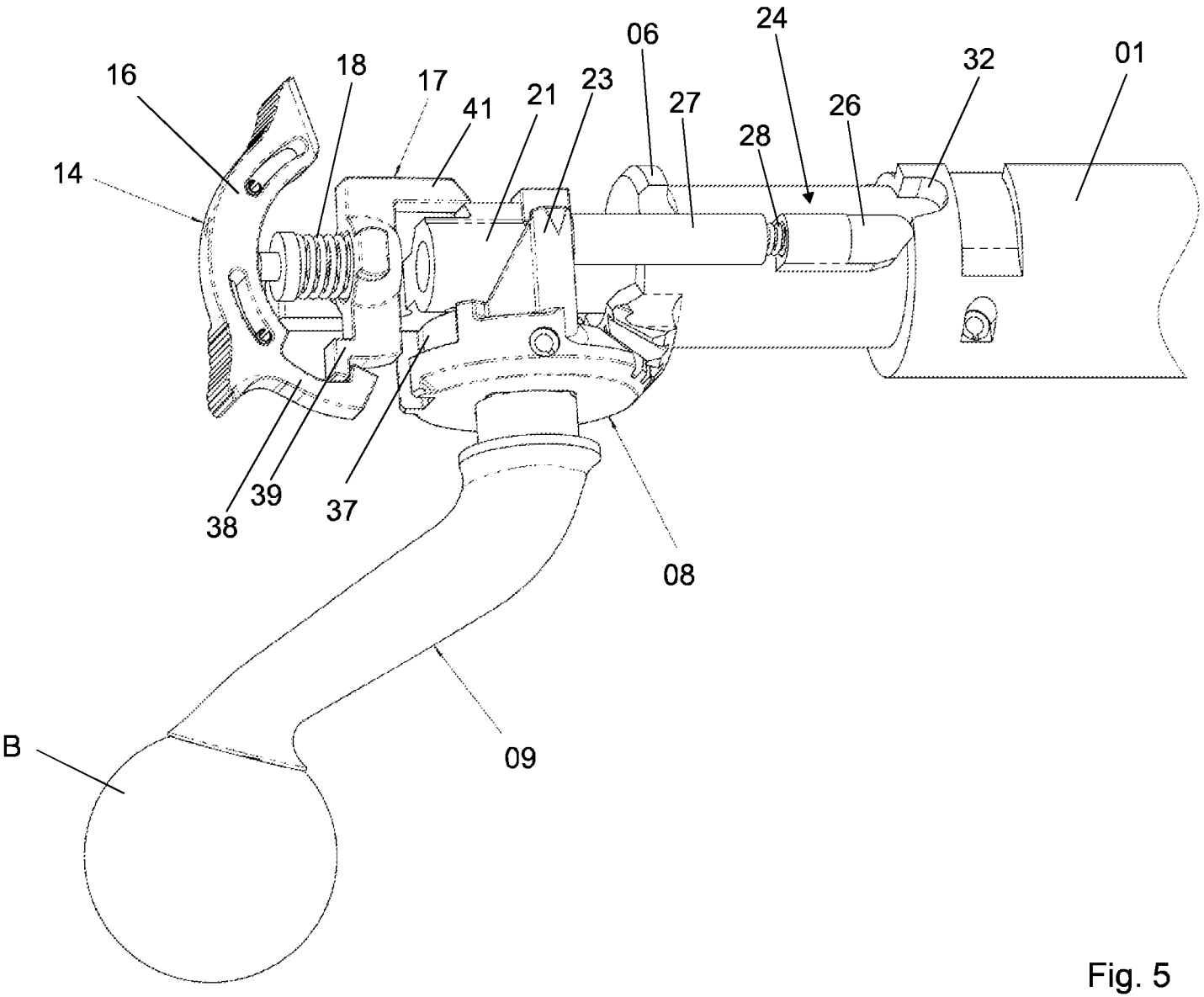
FIG. 5 shows a top view of a rear portion of the straight pull action shown in FIG. 1.

FIG. 5 shows a top view of the straight pull action shown in FIG. 1. In FIG. 5, the bolt-action lever 09 is in the intermediate position B, which is also shown in FIG. 4 and previously described. Deviating from FIG. 4, FIG. 5 shows how the latching element 17 is guided out of the notch 37 of the second bevel gear 08. At one end, the safety slider 16 has a pusher arm 38 that extends axially forward and is angled at its end. The end of the pusher arm 38 extends radially inward. The latching element 17 has two radially extending latching arms 39, 41 which are formed on the latching element 17 opposite one another. The first latching arm 39, which extends in the direction of the pusher arm 38, is formed at an angle at its end so that the pusher arm 38 can engage in the first latching arm 39. If the latching element 17, in particular its first latching arm 39, lies in the notch 37 of the second bevel gear 08, it is possible that the same can be released from the notch 37 by means of the safety slider 16, by engagement in the first latching arm 39, so that a rotation of the bolt-action lever back into the unlocking position C is enabled. The guiding out of the first latching arm 39 from the notch 37 takes place by means of a movement of the safety slider 16 in a radial direction away from the bolt-action lever 09, wherein the pusher arm 38 and the first latching arm 39 engage and perform a joint rearward axial movement. FIG. 5 further shows that in the intermediate position B, the extractor element 24 does not engage the notch 32 of the receiver 01.

Figure 6:
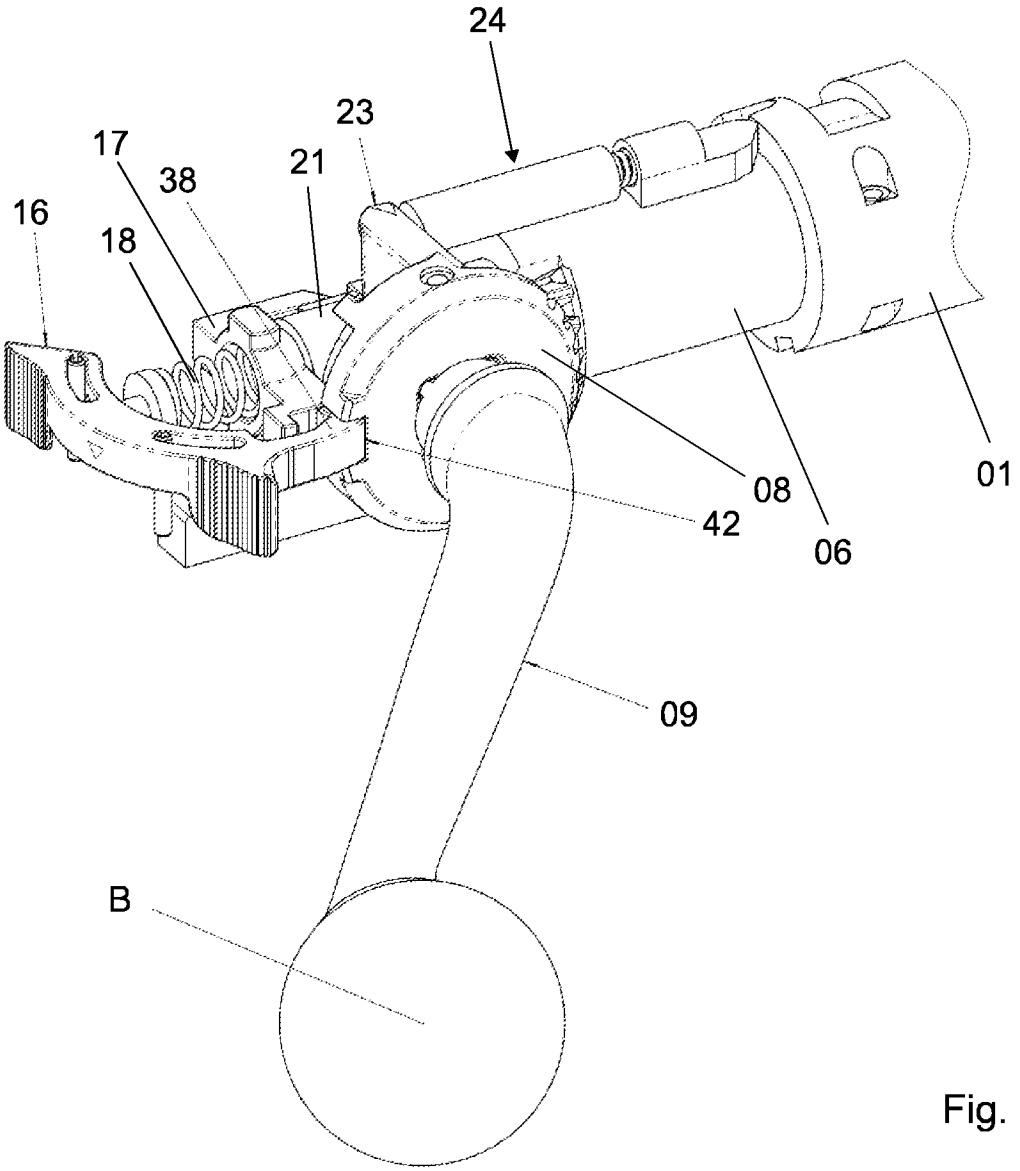
FIG. 6 shows a detail perspective view of the rear section of the straight pull fastener according to FIG. 1 in a locking position.

FIG. 6 shows a detail view of the straight pull action according to FIG. 1 in a secured position. If the bolt-action lever 09 is in the intermediate position B, a secured position of the straight pull action can be configured by means of the safety element 14, whereby the safety slider 16 is moved in a radial direction towards the bolt-action lever 09, whereupon the first latching arm 39 is moved forward parallel to the longitudinal axis 02 and is guided into a groove 42 of the second bevel gear 08. In this secured position, neither cocking of the firing pin spring, firing, reloading or unlocking are possible. The bolt-action lever 09, in the secured position, cannot be moved to the locking position A or the unlocking position C, since these movements are blocked by the engagement of the first latching arm 39 in the groove 42 of the second bevel gear 08. To release the blockage or to move the first latching arm 39 out of the groove 42, the safety slider 16 must be moved as described in FIG. 5.

Figure 7:
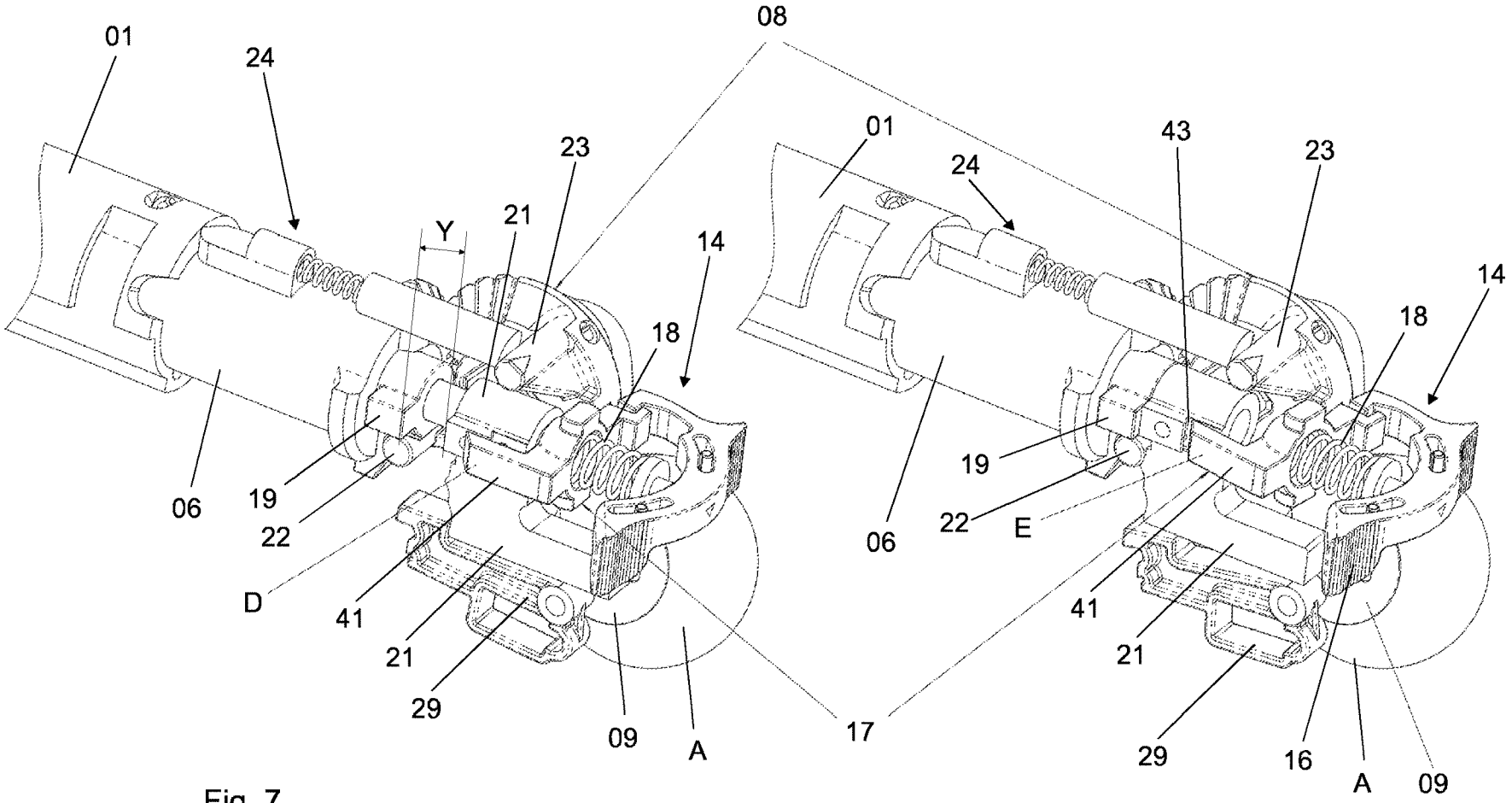
FIG. 7 shows two detail views of the straight pull action according to FIG. 1 before and after firing.

FIG. 7 shows a detail view of the straight pull action according to FIG. 1 before and after a shot is fired. The left figure shows the straight pull shutter before firing. The bolt-action lever 09 was previously pivoted from the unlock position C and/or the intermediate position B to the locking position A. The locking position A, in which the bolt head 03 is locked to the receiver 01, is also shown in FIG. 2. When the bolt-action lever 09 is moved to the locking position A, the second bevel gear 08 rotates with the bolt-action lever 09, wherein the first pin 22 of the second bevel gear 08 is rotated in a clockwise direction with it against the lock sleeve 19 and the lock sleeve 19, the latching tab 21, the firing pin 11 together with the firing pin collar 13 and the firing pin spring 12 move forward along the longitudinal axis 02. If the distance X (shown in FIG. 4) between the latching tab 21 and the trigger sear 29 is shortened to zero, the latching tab 21 runs up against the trigger sear 29. On the basis of a further movement of the bolt-action lever 09, up until reaching the final locking position A, the second bevel gear 08 is moved further forward, together with the first pin 22, and with it the lock sleeve 19. As the latching tab 21 is prevented from further movement at the trigger sear 29, a distance Y is created between the lock sleeve 19 and the latching tab 21, whereby the firing pin spring 12 is tensioned. When the latching tab 21 comes into contact with the trigger sear 29, the firing pin 11 is likewise prevented from moving further forwards. When the locking position A is reached, the straight pull action is 100% locked and the firing pin spring 12 is tensioned so that a shot can be fired.

The illustration on the right shows the straight pull action after firing. During the firing process, which is triggered by a user actuating the trigger 30, the trigger sear 29 is moved downward via the trigger rod 31 so that the latching tab 21 is free to move and is moved forward so that the distance Y is reduced to zero. This releases the firing pin spring 12 and fires the shot by means of the firing pin 11. After firing, the second latching arm 41 of the latching element 17 engages in a lateral recess 43 of the latching tab 21 (position E). If the bolt-action lever 09 is moved back to the intermediate position B or to the unlocking position C after the shot has been fired, the second latching arm 41 of the latching element 17 slides out of the recess 43 of the latching tab 21.

If no shot is fired, the latching element 17 remains in position D and blocks the return movement of the bolt-action lever 09 at the intermediate position B or reaches the unlocking position C after activation of the safety slider 16.

Figure 8:
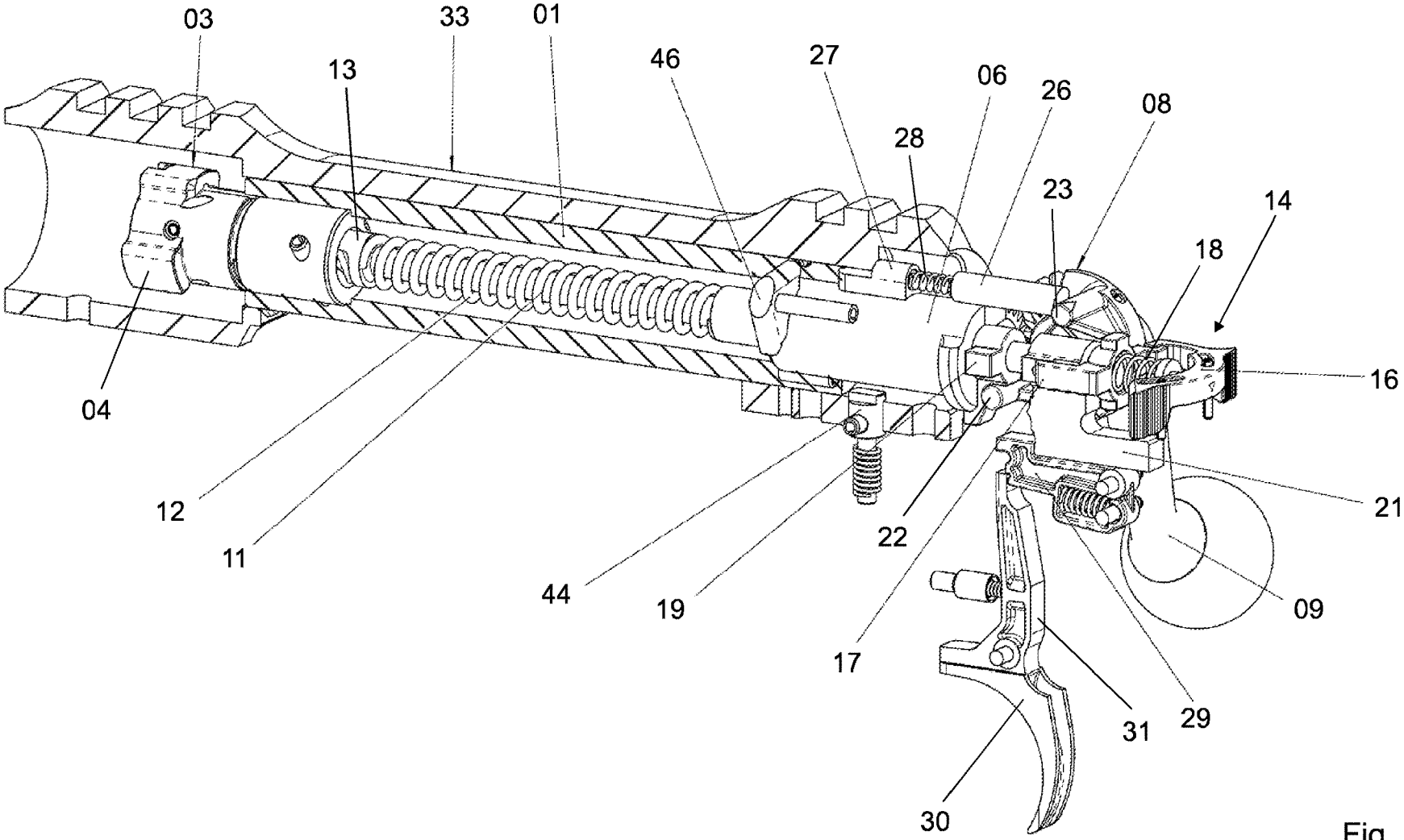
FIG. 8 shows a third perspective view of the straight pull action according to FIG. 1 in a sleeve.

FIG. 8 shows a side view of the straight pull action according to FIG. 1 in the sleeve 33. During axial movement of the bolt-action lever 09 together with the receiver 01, wherein the process has already been described with reference to FIG. 3, rotation of the straight pull action in the sleeve 33 is prevented by a bolt holder 44. The bolt holder 44 is arranged on the lower side of the sleeve 33 in a bore and engages with the receiver 01 in a longitudinal groove (not shown) of the receiver 01 during the forward and backward movement of the straight pull action or alternatively of the bolt-action lever 09, such that the latter cannot be rotated about its longitudinal axis. The maximum opening position of the straight pull action is limited by a plate 46. The plate 46 is arranged in a rear region of the sleeve 33. At the maximum opening position of the straight pull action, the bolt head 03 comes to rest with its lug extensions 04 against the plate 46.

Figures 9, 10, 11:
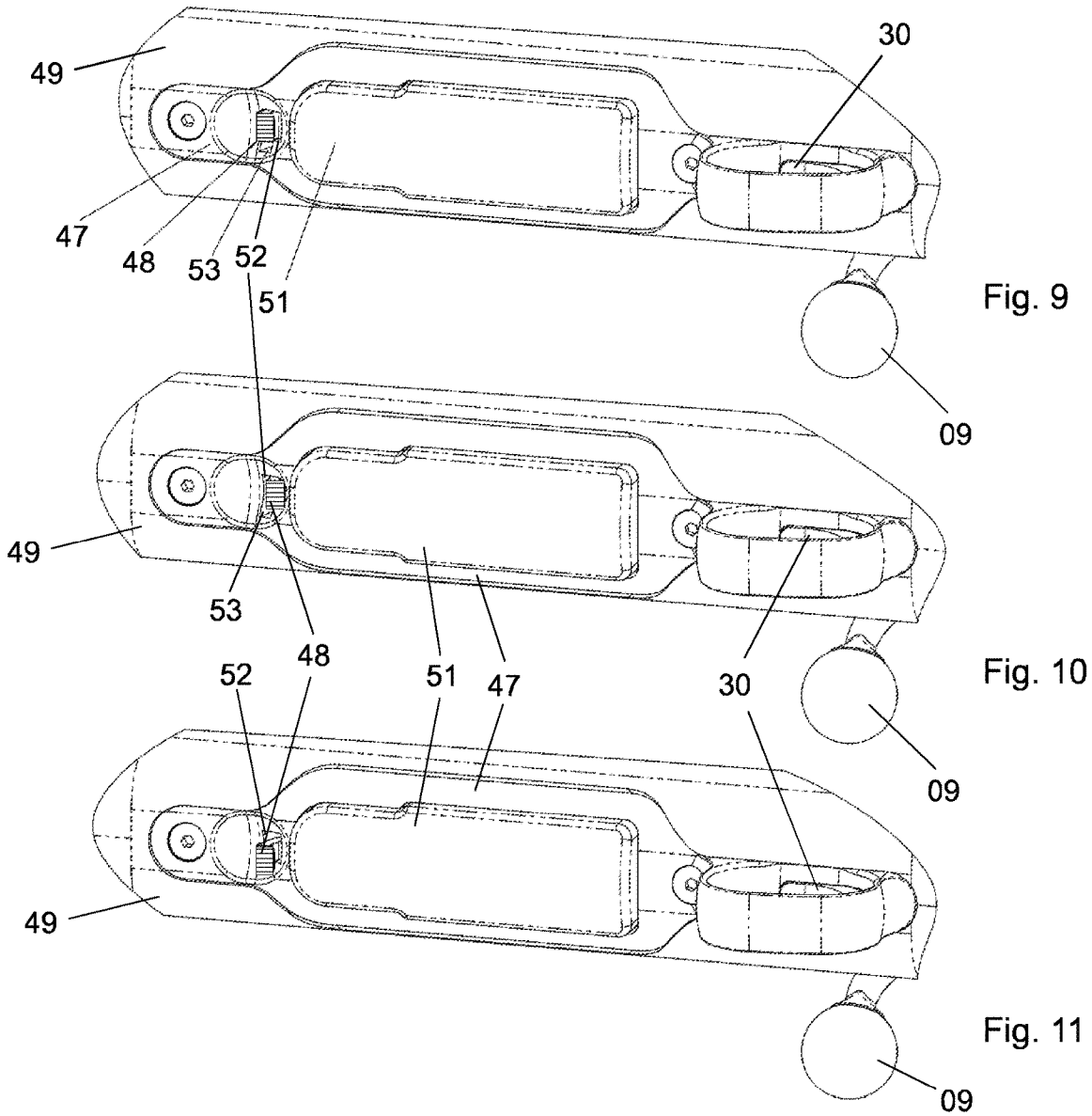
FIG. 9 shows a detail view of a bolt-action weapon with a magazine slot with magazine safety element in an initial position.
FIG. 10 shows a detail view of the bolt-action weapon with the magazine slot with magazine safety element in an ejection position.
FIG. 11 shows a detail view of the bolt-action weapon with the magazine slot with magazine safety element in a safety position.

FIG. 9 shows a detail view of a bolt-action weapon, in particular in the area of a magazine slot 47 located on the underside, which magazine slot is equipped with a magazine safety element 48. The bolt-action weapon is viewed from below, with the trigger 30 and the bolt-action lever 09 also shown. The magazine slot 47 represents a recess in the fore-end 49 of the bolt-action weapon. A magazine 51 is inserted into the magazine slot 47, wherein one or more cartridges (not shown) may be disposed in the magazine 51. The magazine safety element 48 is disposed in an additional cavity 52 at the lower end of the magazine slot 47, the cavity 52 further comprising a groove 53. The cavity 52 extends perpendicular to the longitudinal axis 02 of the weapon. The groove 53 extends transversely to the longitudinal axis 02. The magazine safety element 48 is arranged in an initial position in the cavity 52 in FIG. 9.

FIG. 10 shows a detail view of the bolt-action weapon with the magazine slot 47, with magazine safety element 48 in an ejection position. Initially, FIG. 10 is similar to the view shown in FIG. 9, but in contrast to FIG. 9, the magazine safety element 48 is located in the eject position. The magazine safety element 48 can be brought, by a user, into the eject position, wherein the magazine safety element 48 has been brought from the initial position into an eject position by pushing parallel to the longitudinal axis 02 in the direction of the trigger 30. Once the magazine safety element 48 is in the eject position, the magazine 51 can be removed by the user and reinserted into the magazine slot 47. Insertion of the magazine 51 into the magazine slot 47 is also possible when the magazine safety element 48 is in the initial position.

FIG. 11 shows a detail view of the bolt-action weapon with the magazine slot 47 with magazine safety element 48 in a safety position. FIG. 11 is initially similar to the view shown in FIG. 9 and FIG. 10, but in contrast to FIG. 9, the magazine safety element 48 is in a safety position. The magazine safety element 48 is brought into the safety position by lateral displacement, transverse to the longitudinal axis 02, into the groove 53 of the cavity 52. Advantageously, the displacement of the magazine safety element 48 can be performed with one hand. A further advantage is that in the safety position, the magazine 51 is secured in the magazine slot 47 and unintentional release of the magazine 51 from the magazine slot 47 is also prevented by the magazine safety element 48.

The invention claimed is:

1. Straight pull action for bolt-action weapons, comprising a receiver which can be rotated about a longitudinal axis and can be displaced axially along this longitudinal axis with a front end, at which a bolt head is arranged fixedly in terms of rotation, and a rear end, at which a first gear component is arranged fixedly in terms of rotation, wherein the receiver rotates with the rotation of the first gear component;

a second gear component which lies at an angle to the first gear component and engages therewith to transmit rotational motion; and a bolt-action lever, which is connected to the second gear component, so that the bolt-action lever can be rotated together with the second gear component about a common axis of rotation at least in sections, wherein the bolt-action lever can be locked in at least two functional positions (A, C), such that by means of the two gear components and with the receiver (01) in a locking position (A) of the bolt-action lever, the bolt head is locked and in an unlocking position (C) of the bolt-action lever, the bolt head is unlocked, and wherein the bolt-action lever, jointly with the two gear components and the receiver with the bolt head are movable back and forth in the axial direction parallel to the longitudinal axis (02).

2. The straight pull action according to claim 1, wherein a firing pin arranged coaxially with the receiver and having a firing pin collar in the front region, as well as a firing pin spring arranged coaxially on the firing pin, wherein the firing pin spring abuts on the firing pin collar.

3. The straight pull action according to claim 2, further comprising a lock sleeve arranged on the first bevel gear and a latching tab, which is positioned on a rear portion of the firing pin, wherein the latching tab is fastened to the firing pin so that it cannot rotate.

4. The straight pull action according to claim 3, wherein the second gear component has two spaced out pegs extending parallel to the axis of rotation, on its surface opposite the bolt-action lever, wherein the first peg abuts the lock sleeve and, upon rotation of the bolt-action lever into the locking position (A), brings about movement of the firing pin, the latching tab and the lock sleeve along the longitudinal axis.

5. The straight pull action according to claim 4, further comprises further comprising a trigger sear against which the latching tab comes to abut upon rotation of the bolt-action lever into the locking position (A) and is thereby prevented from further movement along the longitudinal axis, so that the distance between the firing pin collar and the lock sleeve is reduced, thereby tensioning the firing pin spring.

6. The straight pull action according to claim 4 further comprising an extractor element which is guided into a notch of the receiver by means of the second peg of the second gear component when the bolt-action lever is in the unlocking position (C), such that a rotational movement of the receiver and thus of the two bevel gears is prevented and, at the same time by supporting the extractor element on a contact surface of the sleeve or of a rifle barrel, a forcedly-controlled extraction of a cartridge sleeve from a chamber is realized.

7. The straight pull action according to claim 1, further comprising a safety element for blocking or releasing rotational movement of the bolt-action lever, wherein, in a deactivation position, the safety element engages in a groove of the second bevel gear to block rotational movement thereof and thereby of the bolt-action lever, and wherein in an activation position, the safety element acts in a non-blocking manner on the second component.

8. The straight pull action according to claim 1, wherein the bolt-action lever is movable into an intermediate position (B).

9. The straight pull action according claim 1, wherein the first gear component is formed by a first bevel gear (06) and the second gear component is formed by a second bevel gear.

10. A bolt-action weapon having a straight pull action, wherein the straight pull action is formed according to claim 1, further comprising a rifle barrel, as well as a fore-end and a buttstock.

11. A bolt-action weapon according to claim 10, further comprising a chamber, a magazine slot adjacent to the chamber in the form of a recess in the fore-end into which slot a magazine can be inserted, as well as a magazine safety element which is lockable in its position in a groove by a displacement that is transverse to the longitudinal axis.

* * * * *